United States Patent [19]

Lamborn

[11] 3,977,525

[45] Aug. 31, 1976

[54] MECHANICAL REMOVAL OF FLAT POD ROGUES FROM SNAP BEAN SEED

[75] Inventor: Calvin R. Lamborn, Twin Falls, Idaho

[73] Assignee: Gallatin Valley Seed Co., Twin Falls, Idaho

[22] Filed: Sept. 17, 1975

[21] Appl. No.: 613,985

[52] U.S. Cl. ..... 209/75; 209/99; 209/85

[51] Int. Cl.[2] ..... B07C 1/10; B07B 13/04

[58] Field of Search ..... 209/75, 99, 83, 85, 209/234, 313, 314

[56] References Cited

UNITED STATES PATENTS 45,517 12/1964 Patterson ..... 209/314 X 3,709,329 1/1973 Mlodzinski ..... 209/75

*Primary Examiner*—Allen N. Knowles

*Attorney, Agent, or Firm*—Robert G. Slick

[57] ABSTRACT

Flat pod rogues are removed from snap bean seed stock by a mechanical separation process wherein the seeds are first sized through a plurality of round holes and each size category is then further sized on slotted screens wherein the size of the slots is slightly smaller than the diameter of the round holes through which that size of beans passed, whereby the flat seeds pass through the slots and the round seeds are retained on the screen. Preferably, the slotted screens have diverging slots with a plurality of separate bins thereunder whereby the roundest seeds will travel farthest on the rods and beans can be divided into several degrees of roundness.

9 Claims, 10 Drawing Figures

MECHANICAL REMOVAL OF FLAT POD ROGUES FROM SNAP BEAN SEED

SUMMARY OF THE INVENTION

In growing snap bean seeds, one of the problems is that of flat pod rogues. All varieties of snap beans appear to have this problem. The flat pod rogue is a sport or mutant wherein the pods are wider in the dorsal-to-ventral suture dimension and narrower in cross section than the normal pods. In the commercial canning or freezing of snap beans, the pods are sorted on rod sorters wherein the young, small beans will fall through while the older, tougher beans will be retained on the rods. However, in the case of the flat pod rogues, older, tougher beans will fall in with the younger, normal beans so that the beans cannot be packed as a "fancy" grade. Besides their flatter appearance, these flat pods are generally more mature with larger seeds and a much higher content of fiber than the standard beans.

There is a high rate of mutation to the flat pod type in all snap bean varieties. In addition to new mutations appearing each year, the mutation is genetically stable and it even appears that the flat pod plants have a reproductive advantage over the standard plants. Thus, if no control measures are taken, the flat pod percentage in a crop will build up at an increasing rate year after year.

It has been observed that the seeds of the flat pod rogue are somewhat flattened, but the average degree of flattening is very slight, i.e., on the order of 0.008 to 0.016 inches. There have been proposals for mechanically processing these seeds in some manner to take advantage of this small out-of-round difference in an effort to get rid of the flat pod rogue seeds.

One proposal was to segregate the beans by weight, and another was to use a single screening method. Still another proposal was to take advantage of the fact that the normal beans would roll more readily than the flat seeds so that the seeds were placed on a slanting belt in an attempt to take advantage of the tendency of the round seeds to roll more than the flat seeds and thus segregate the seeds.

None of these proposed methods has proved to be of any substantial value, and the only method which has proved even partially successful is that of roguing. Roguing consists of going through the production fields with large crews to find the flat pod plants and pull them out. It is difficult to spot the flat pod plants and usually only about one-third of the flat pod plants are found and removed. The time for doing this is quite limited and roguing is a difficult and unpleasant job. The cost of properly roguing a field could exceed the value of the seed recovered.

In accordance with the present invention, a purely mechanical method has been found by which bean seeds can be treated to separate the seeds into fractions wherein a large percentage of the flat pod seeds will be segregated from the normal or round pod seeds.

Another object of the present invention is to provide a mechanical grader or separator having a large throughput wherein bean seeds can be divided into a plurality of fractions, each containing varying percentages of rogue seeds.

Still another object of the present invention is to provide a superior mechanical segregating system wherein there is little tendency for the seeds to become lodged or hung up in the equipment.

Another object of this invention is to provide segregating equipment wherein the seeds are gently handled and not subjected to drops or other stresses which would result in lowering the germination of the seeds.

A still further object of the invention is to provide a seed management system wherein substantially all of the seeds from a crop can be utilized for seed purposes, yet the percentage of flat pod rogues in the seed stock will be reduced from year to year.

Another important benefit gained in the process of the present invention is that mixtures of some dry edible beans are also completely removed from the roundest category.

Various other objects and advantages of the present invention will be brought out in the balance of the specification.

DESCRIPTION OF THE PREFERRED EMBODIMENTS

Figure 1:
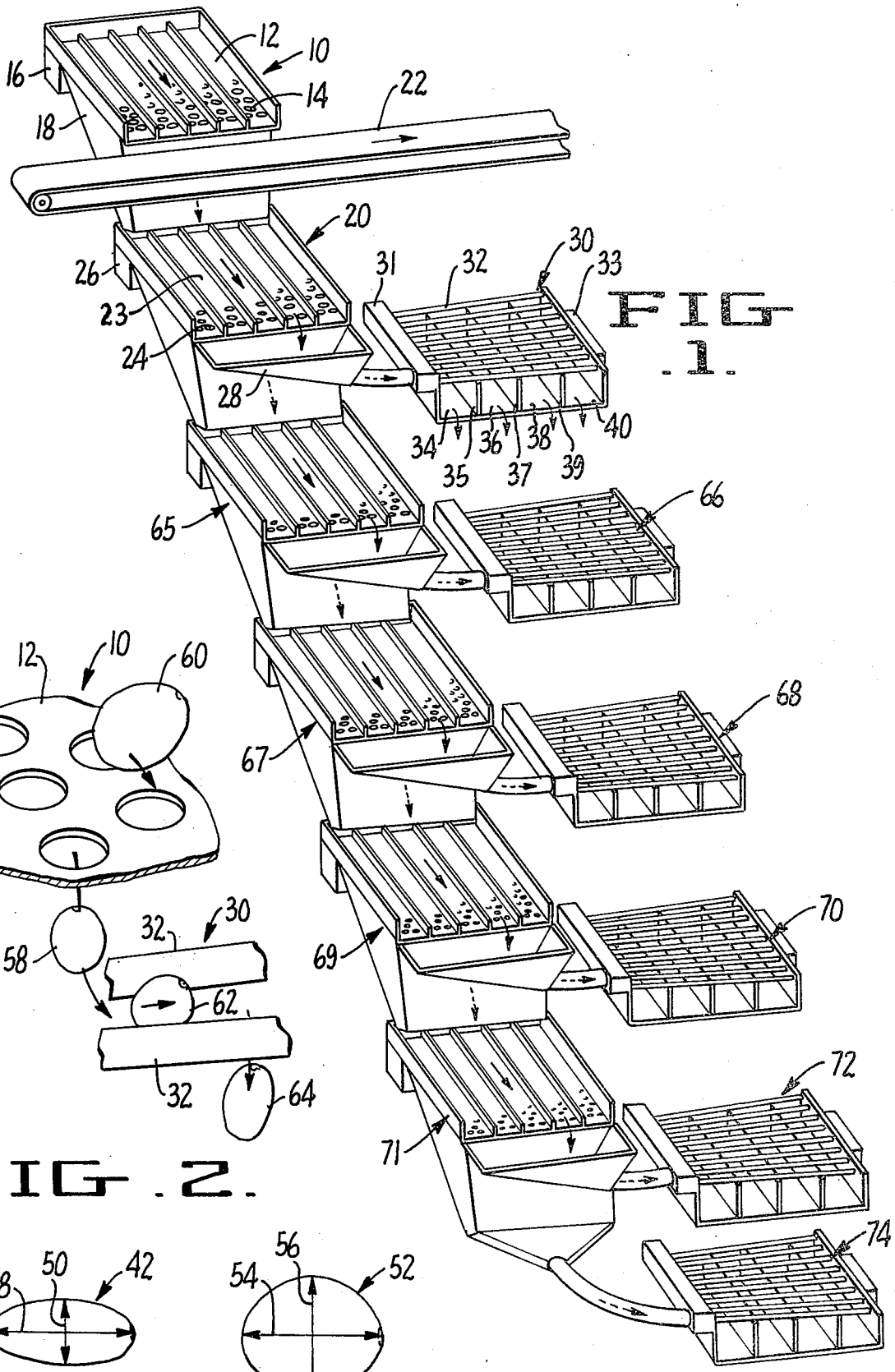
FIG. 1 is a perspective view of a seed processing machine embodying the present invention.

In general, the method of the present invention is carried out by passing the seeds first into a plurality of vibrating separators wherein the separators have round holes of decreasing size which, in effect, divide the seeds into a large number of individual sizes. Each of the seed sizes is then placed on a slot separator wherein the slots or elongated openings are provided by a series of rods which diverge slightly. A plurality of bins is provided under the separators so that the seeds of a given size are separated by the degree of roundness. The spacing between the rods is initially slightly less than the diameter of the round holes. Thus, round beans cannot pass through the slots but flat seeds can. At the far end of the separator, the spacing between the slots is substantially equal to the diameter so that round seeds can pass through the slots. Thus, the roundest seeds will ride out to the farthest bin while the flattest seeds will drop into the first bin, with intermediate degrees of flatness in between. Ordinarily, a preliminary separation would be made of the largest seeds and they would be eliminated from further sorting operations.

In the drawings, there is shown a first separator generally designated 10 having a bottom 12 with a series of round holes 14 therein. Separator 10 has a vibrating attachment 16 mounted thereon and a collector 18 thereunder. Conveyor 22 is employed to remove oversized seeds which do not go through the holes. The seeds which pass through separator 10 and which are collected on collector 18 pass over the separator 20 which has a bottom pan 23 with round holes 24 therein. As will be later explained in detail, holes 24 are slightly smaller than holes 14. Pan 23 is shaken by vibrator 26 and the seeds which pass over the top of pan 23 go into collector 28 and into the feed pan 31 of slot separator 30. The slot separator 30 has a series of rods 32 which are slightly diverging, as is later explained in detail, and have a vibrator 33 connected thereto. Under the slot separator 30 are four bins, namely 34, 36, 38 and 40 formed by the partitions 35, 37 and 39. Since the rods 32 are diverging, the flattest seeds will collect in bin 34, and the roundest in bin 40 with the intermediate degrees of roundness in bins 36 and 38. Normally, the partitions 35, 37 and 39 would be adjustable so that one could create more than four bins or fewer than four, or vary the size of the various bins. The distance between the rods over the bin 34 will be slightly smaller than the diameter of the holes 14 through which the beans passed, while the distance between the rods over the bin 40 will be about the same in size as the diameter.

Figure 2:
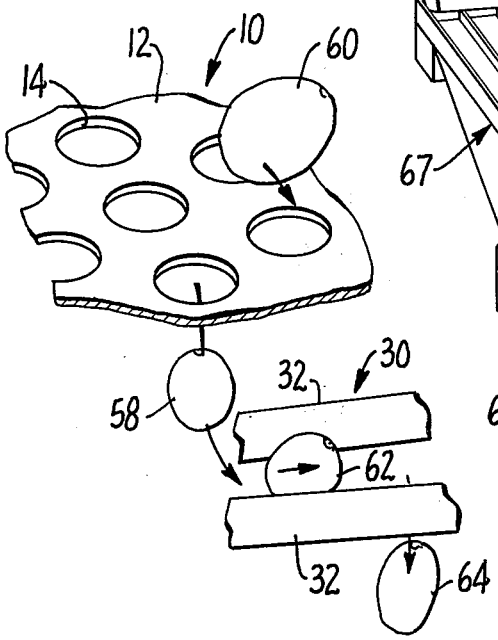
FIG. 2 is an enlarged fragmentary view showing the two types of screening devices used in accordance with the present invention, namely, a round-holed screen in combination with a slotted screen.
Figure 3:
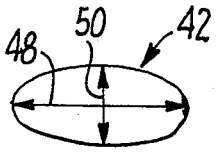
FIG. 3 is a sectional view of a flat pod rogue bean seed with the flatness grossly exaggerated.
Figure 4:
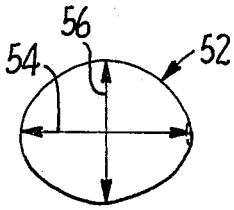
FIG. 4 is a similar section of a normal bean seed.
Figure 5:
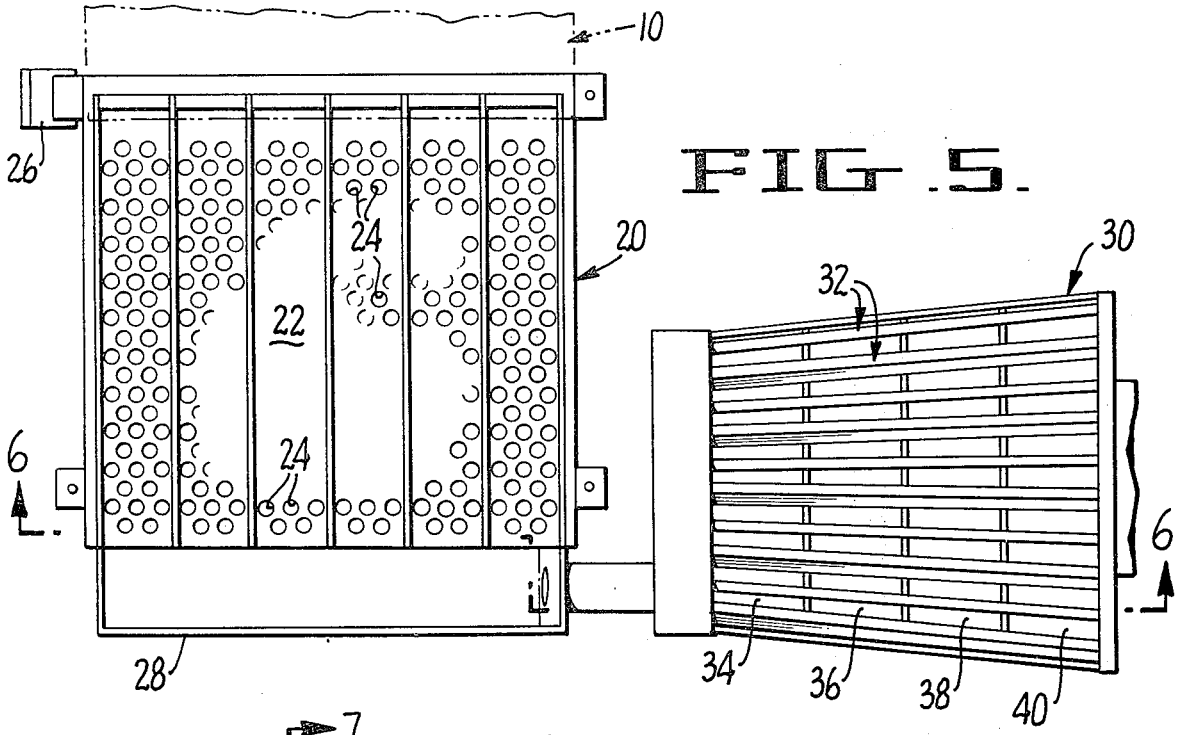
FIG. 5 is a top plan view of a combination round hole and slot screen constituting one of the stages shown in FIG. 1.
Figure 6:
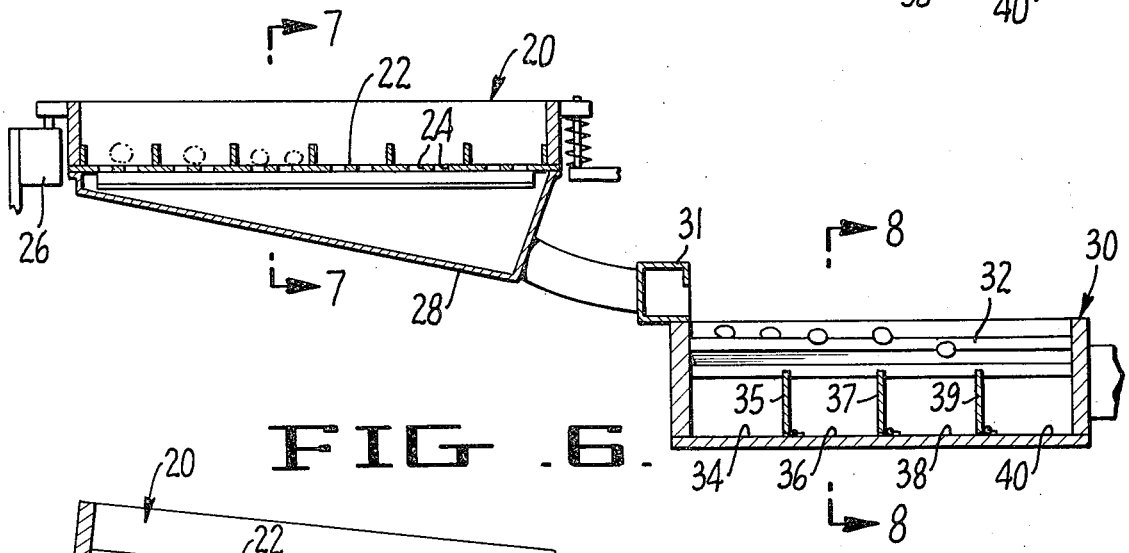
FIG. 6 is a section on the line 6—6 of FIG. 5.

The action of the combination of the separators 10 and 30 can easily be seen in FIGS. 2, 3 and 4. In FIG. 3, there is shown a cross section of a flat pod rogue seed 42, but the flatness is grossly exaggerated. It will be readily apparent that the cross section dimension shown by the arrow 48 is substantially greater than the side-to-side dimension shown by the arrow 50. In FIG. 4, a normal bean 52 is shown wherein the cross section dimension, shown by arrow 54, is substantially the same as the side-to-side dimension 56. As has been said before, the drawings are grossly exaggerated and the average flattening may only be on the order of 0.008 to 0.016 inches.

Referring now specifically to FIG. 2 which represents a diagrammatic enlargement of the separators 10 and 30 (separator 20 can be ignored for the moment since the beans of immediate interest merely roll over it), a bean 60 which is larger than one of the holes 14 will merely roll over the top of the pan 12 and onto the conveyor 22. A bean 58 which is small enough to pass through one of the holes 14, but too large to go through holes 24, falls onto the slot separator 30. The rods 32 are diverging and a bean 64 which is somewhat flat will immediately fall between the rods while a bean 62 which is somewhat round will ride out on the rods 32. At the entrance end of the separator, the spacing between the rods 32 is slightly less than the diameter of the hole 14 through which that size of bean has passed, while the distance between the rods at the terminal ends will be substantially equal to the diameter of the hole 14. Thus, any bean which passes through the hole 14 will eventually fall between the rods 32.

It will be seen that there is a cascade of separators having round holes, namely, 65, 67, 69 and 71 and that in each case, the beans which roll over the top of the separator go to a companion rod separator while those beans which pass through the holes of the round separator fall onto the pan of the next round-holed separator. The companion slot separators are designated 66, 68, 70, 72 and 74. The only exception to this scheme is in the case of the last round-holed separator 71 wherein the beans which pass through the holes go to the slot separator 74 while those which pass over the holes go to the slot separator 72. The ratios of the diameter of the round holes and width slots in the several separators are given in more detail hereinafter.

Normally, the contents of all of the first bins, i.e., the bins corresponding to bin 34 would be combined into one fraction, and all of the second bins, third bins and fourth bins would be likewise combined, but various combinations can be made of the fractions.

Figure 7:
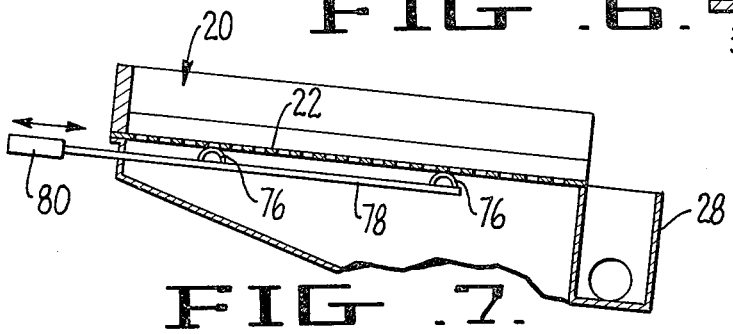
FIG. 7 is a section on the line 7—7 of FIG. 6.
Figure 9:
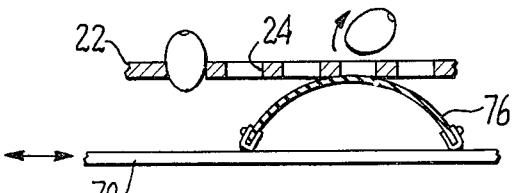
FIG. 9 is an enlarged section of one of the rubber brushes shown in FIG. 7.

It was found that many beans would lodge in the round holes and an attempt was made to prevent this. It was found that brushes under the screens were ineffective since the spring action of a brush would frequently cause beans to jump completely off of the screen. It was found that an effective yet gentle method of dislodging beans which were caught in the holes was the employment of rubber arches. As is shown in FIGS. 7 and 9, these consist merely of an arched piece of rubber 76 mounted on a support 78, with means for moving the support 78 back and forth such as a hydraulic cylinder 80.

Figure 8:
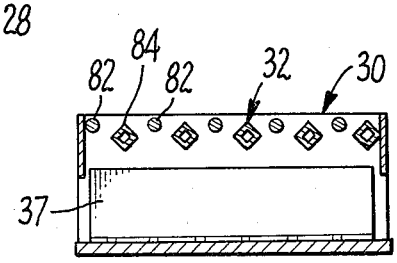
FIG. 8 is a section on the line 8—8 of FIG. 6.

In the case of the slotted screens, it was found that beans would frequently stick between the rods or bars and not move properly along the separator. It was found that by not using uniform bars or rods, but by employing round rods such as those designated 82 in FIG. 8, alternating with square bars or tubes 84, there was a sufficient difference in vibration imparted to the beans so that the beans would not lodge in the slots.

It is the usual practice to place milling screens in a down slope position and move the seed across them with a shaking or eccentric action. However, in the case of the round and slot screens, it has been found advantageous to mount the screens with a slight slope upwardly, such as a 1° or 3° slope. The greater the slope the higher the degree of exactness or precision of separation, at the expense of through put or capacity. Normally, a slope of 1° or 2° will give satisfactory results. In one practical embodiment the screens use electromagnetic vibrators. These vibrators give a straight line vibration which will drive the seed up a slight angle.

In one practical embodiment of the invention, the various separating screens were sized and operated as follows:

The round-holed screens 10, 20, 65, 67, 69 and 71 are set in a stair-step pattern as is shown in FIG. 1 in which the largest holed screen is at the top. The seed which goes through each screen is introduced on top of the next smaller holed screen. In this embodiment of the invention, the largest round holes are 16/64 of an inch and go down half a screen size on each successive screen. The sizes, thus, are:

16/64, 15½/64, 15/64, 14½/64, 14/64 and 13½/64.

This series of six round-holed screens divides each lot of seed into seven categories according to size.

The one size seed which goes over the first and larger round-holed screen 10 is fed onto conveyor 22 and is not run over a rod grader because of the range of larger seed in this category.

The seed which goes through all of the round-holed screens is fed through a plastic tube and onto the feeder-pan 31 of the last rod grader.

Under each round-holed screen there is a rod grader. The slots in each rod grader are 4/64 of an inch wider at the back than at the front. The slots in the first rod grader range from 12/64 to 16/64 so that its greatest width is the same as the diameters of the round holes of that particular stage. The next rod grader has slots from 11½/64 to 15½/64. Each rod grader down the line has slots ½/64 of an inch narrower. The last rod grader in the series sizes the seed which went through the smallest round screen 71 whereas, all the other rod graders size the seed which went over the corresponding round screens.

Under each rod grader there are three adjustable cut-off plates as shown. These plates divide each size of seed into four categories of flattest to roundest.

At this stage of the operation, the total lot of seed is divided into 25 different fractions. (Four categories of roundness for each of the six different sizes and the one fraction of oversized seed.)

The seed fractions are recombined into four categories of flattest to roundest, i.e., the first bins under all of the slotted conveyors are combined, and so on. The one oversized fraction is included with the flattest category.

The four categories can be further combined into as few as two categories. The final number of categories will depend on the particular problems and needs of each lot of seed run.

The following working examples illustrate the results obtained in carrying out the invention.

EXAMPLE 1 (experiment sample)

Figure 10:
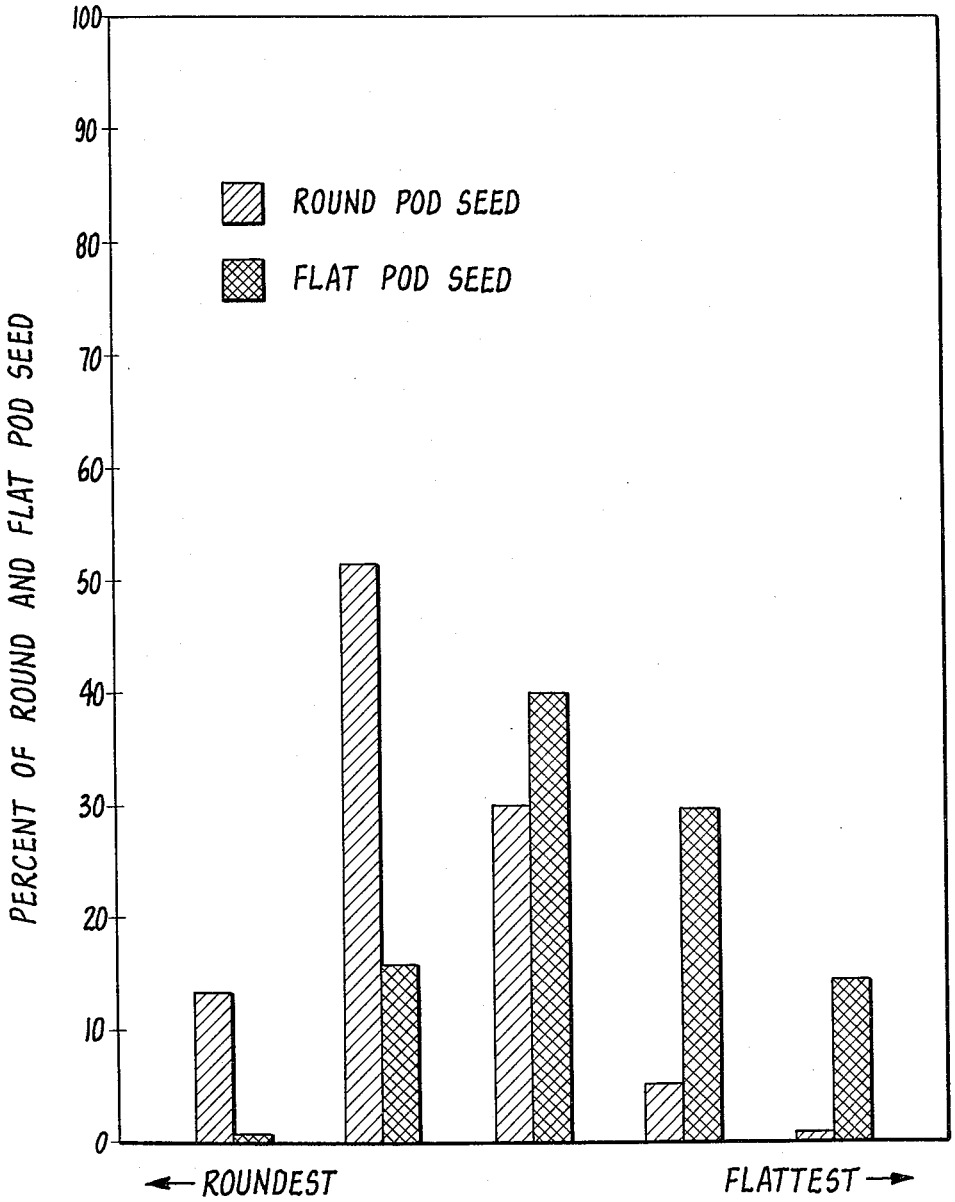
FIG. 10 is a bar graph showing a typical distribution of round and flat pod seeds processed in accordance with the present invention.

The seed employed was of the variety Gallatin 50, and the seeds contained about 25% of flat seeds (flat pod seed were colored and added). The difference in dimensions of the flat and the normal round seeds was about 0.016 inches. The seeds were passed through equipment substantially the same as that shown in the drawings except that in the vibrating slot conveyors the seed was separated into five categories ranging from the roundest to the flattest. The results were as is shown in FIG. 10. It will be seen from the drawing that the roundest category contained 13% of the round and 0.7% of the flat pod seeds. On the other hand, by combining all the remaining fractions, there was only a 12.3% increase in the number of flat pod seed. The roundest category shows a reduction in flat pods which was about three times greater than commonly achieved by field roguing.

EXAMPLE II (production lot)

The procedure of Example I was followed except that the variety was Early Gallatin and the results were as follows: This production lot of seed contained 1.7% flat pods before processing. The roundest category contained 26.4% of the total lot. A field survey of the roundest category showed that the number of flat pod plants had been reduced to 0.1%. This example showed the greatest decrease in the percent of flat pod of all varieties processed in accordance with the present invention. Seven different varieties have been processed and the results are similar to that found in Example I. The varieties tested were as follows:

| | | |
|---|---|---|
| Gallatin 50<br>Galagreen,<br>Gallatin | Encore<br>GV BBL No. 2 | Resistant Kinghorn Wax<br>Galamor and Early |

When the seed lots are divided into categories of roundest to flattest, the flat pod seed population is shifted into the flatter categories. This means that while the roundest and next to the roundest categories have a reduction in the number of flat pods, the flattest and next to the flattest categories have an increase in flat pods.

The objective is to take a small percent in the roundest category and use it as mother seed stock. If the shift away from flat pods is greater than the natural tendency toward them then each generation the seed is processed, the population of flat pods should become smaller and smaller.

If 10% of the lot is taken out in mother seed stock and if all the flat pod seed were shifted into the other categories, the increase in flat pod would only be about 10%. In most cases a 10% increase would not render the lot unsaleable. This increase can also be reduced by blending the lot with another lot which has not been processed.

With the apparatus described, one starts with the largest round holes and then feeds each size category onto a rod grader. This combination is the easiest and most effective way to use the screens. It would be possible to run the process in reverse. One could start with the smallest round holed screens or even the slotted screens. Many other variations can be made without departing from the scope of this invention.

I claim:

1. The method of separating flat pod rogue bean seeds from normal bean seeds comprising the steps of:

a. passing the seeds through a series of screens, said screens having substantially round holes, each of said screens having holes of decreasing size, whereby said seeds are divided into a plurality of size groups, and b. passing each individual size group onto individual slotted screens, said slotted screens having slots narrower than the diameter of the round holes through which that size category passed whereby flat pod rogue beans will fall through said slots, and normal, round beans will be retained on said slotted screen.

2. The method of claim 1 wherein said slotted screens have diverging slots whereby the flattest seeds will fall through the narrowest portion of the slots and wherein rounder seeds will fall through said screen at a wider portion of the slots, and means for separating said seeds into a plurality of fractions based on the width of the slots through which the seeds passed.

3. An apparatus for the separation of bean seeds to concentrate flat pod rogue seeds into certain fractions of the bean seeds comprising:

a. a plurality of first screen means, said first screen means having substantially round openings therein whereby a lot of beans can be segregated into a plurality of size groups, b. a plurality of second screen means, each having slots therein narrower than the round holes of a corresponding member of said first screen means, and c. means for moving beans separated for roundness into discreet size groups individually onto said slotted screens whereby said beans are segregated into fractions containing a larger and a smaller percentage of flat pod rogues than the percentage of flat pod rogues in the original lot of beans.

4. The structure of claim 3 wherein said second screen means comprises a slotted screen wherein the slots diverge from a relatively small entrance section of the screen to a relatively large terminal portion of the screen, whereby the position of seeds falling through the slotted screen is determined by the degree of flatness of the seeds.

5. The structure of claim 4 having a plurality of bins under said slotted screens including at least a first bin under the narrow portion of the slots and a second bin under a wider portion of the slots.

6. The structure of claim 3 wherein each of these first and second screen means is provided with a vibrator.

7. The structure of claim 3 wherein each of the first screen means is provided with a movable rubbing means under the screen, said rubbing means comprising a rubber arch and means to push the rubber arch back and forth against the bottom of the screen.

8. The structure of claim 3 wherein the slotted screen means comprises alternating square bars and round bars.

9. The structure of claim 4 wherein the slotted screen means tilts upwardly at an angle of about 1° to 2°.

* * * * *